US006233965B1

(12) United States Patent
Choy

(10) Patent No.: US 6,233,965 B1
(45) **Date of Patent: *May 22, 2001**

(54) INSULATED SHIPPING CONTAINER

(76) Inventor: Anthony Choy, 1346-8$^{th}$ Ave., San Francisco, CA (US) 94122

( * ) Notice: Subject to any disclaimer, the term of this patent is extended or adjusted under 35 U.S.C. 154(b) by 0 days.

This patent is subject to a terminal disclaimer.

(21) Appl. No.: 09/464,299

(22) Filed: Dec. 15, 1999

Related U.S. Application Data

(63) Continuation of application No. 09/040,731, filed on Mar. 18, 1998.

(51) Int. Cl.$^{7}$ ..... F25D 3/08

(52) U.S. Cl. ..... 62/371; 62/60; 62/459.2; 220/1.5; 220/1.6; 220/228

(58) Field of Search ..... 62/371, 60, 459.2; 220/1.5, 1.6, 228

(56) References Cited

U.S. PATENT DOCUMENTS

| | | | | |
|---|---|---|---|---|
| 3,349,990 | | 10/1967 | Woodford . | |
| 4,050,264 | | 9/1977 | Tanaka . | |
| 4,535,828 | | 8/1985 | Brockhaus . | |
| 4,537,313 | | 8/1985 | Workman . | |
| 4,679,242 | | 7/1987 | Brockhaus . | |
| 4,903,493 | * | 5/2000 | Van Iperen et al. | 62/60 |
| 5,105,970 | | 4/1992 | Malone et al. . | |
| 5,143,245 | | 9/1992 | Malone . | |
| 5,216,900 | | 6/1993 | Jones . | |
| 5,219,075 | | 6/1993 | White . | |
| 5,355,684 | * | 10/1994 | Guice | 62/54.2 |
| 5,419,152 | * | 5/1995 | Silber | 62/372 |
| 5,454,471 | | 10/1995 | Norvell . | |
| 5,505,307 | | 4/1996 | Shink . | |
| 5,548,972 | | 8/1996 | Wallace . | |
| 5,595,320 | | 1/1997 | Aghassipour . | |
| 5,669,233 | * | 9/1997 | Cook et al. | 62/371 |
| 5,924,302 | * | 7/1998 | Derifield | 62/457.2 |
| 6,055,825 | * | 5/2000 | Choy | 62/371 |
| 6,089,038 | * | 7/2000 | Tattam | 62/457.2 |
| 6,119,465 | * | 9/2000 | Mullens et al. | 62/60 |

* cited by examiner

*Primary Examiner*—William Doerrler
*Assistant Examiner*—Mark Shulman
(74) *Attorney, Agent, or Firm*—Malcolm B. Wittenberg

(57) ABSTRACT

A container having insulating properties for shipping products. The container includes a flexible pouch capable of being folded to a substantially flat, two-dimensional geometry. The container further includes at least one cylindrically shaped elastomer having a radial dimension and height dimension shaped to fit within the flexible pouch and being more resistant to deformation in its height dimension than in its radial dimension and at least one cylindrically shaped metalized membrane sized to fit within the cylindrically shaped elastomer. A geometrically shaped top and bottom are each sized to fit within the cylindrically shaped elastomer which are used to determine the shape of the container as well as its internal volume.

3 Claims, 4 Drawing Sheets

INSULATED SHIPPING CONTAINER

This application is a continuation of U.S. Ser. No. 09,040,731 filed Mar. 18, 1998.

TECHNICAL FIELD OF THE INVENTION

The present invention involves a shipping container capable of containing a variety of products, sizes and shapes. The container is particularly designed to ship product requiring thermal insulation in order to maintain product integrity for the period of time over which the shipping process takes place.

BACKGROUND OF THE INVENTION

There are a wide variety of containers used for shipping product over conventional channels. Whether shipping is done by air, cargo vessel, rail or truck, all shipping containers must exhibit certain basic characteristics depending upon the product being transported. The present invention deals specifically with containers which are useful in shipping product which are perishable or otherwise require the maintaining of a somewhat constant temperature independent of ambient temperature. Most often, such containers include cold packs and insulative side walls which help to maintain a refrigerated environment throughout the internal volume of the container.

Insulative shipping containers heretofore have required that the user sacrifice flexibility for insulation. Commonly, such containers consist of outer membranes such as cardboard boxes housing blocks of rigid Styrofoam®, polyurethane or similar non-heat conducting products. Although in practice, such containers provide a degree of thermal insulation, they are bulky and inconvenient to store. Furthermore, Styrofoam® and polyurethane insulation are brittle, environmentally unfriendly, show little integrity upon being exposed to moisture and are not readily reusable.

Others have also suggested the use of flexible sacks for shipping product but despite their obvious advantages, soft-sided pouches provide little in the way of thermal insulation or protection of shipped product from that physical abuse commonly encountered when dealing with commercial carriers.

It is thus an object of the present invention to provide an improved shipping container which is devoid of the disadvantages recited above.

It is another object of the present invention to provide an improved shipping container having flexible walls yet demonstrating vertical structural integrity.

It is yet a further object of the present invention to provide a shipping container capable of being stored in a compact space yet being capable of providing adequate internal volume for shipping of product in an insulated fashion.

These and further objects will be more readily appreciated when considering the following description and appended claims.

SUMMARY OF THE INVENTION

The present invention is directed to a container having insulating properties for shipping products. The container comprises a flexible pouch capable of being folded to a substantially flat, two-dimensional geometry, at least one cylindrically shaped elastomer is provided having a radial dimension and height dimension, shaped to fit within the flexible pouch and being more resistant to deformation in its height dimension than its radial dimension. At least one cylindrically shaped metalized membrane is employed which is sized to fit within the cylindrically shaped elastomer. The invention is completed with geometrically shaped top and bottom elements each sized to fit within the cylindrically shaped elastomer and each determining the shape of the container by deforming the shape of the elastomer.

DETAILED DESCRIPTION OF THE INVENTION

Figure 1:
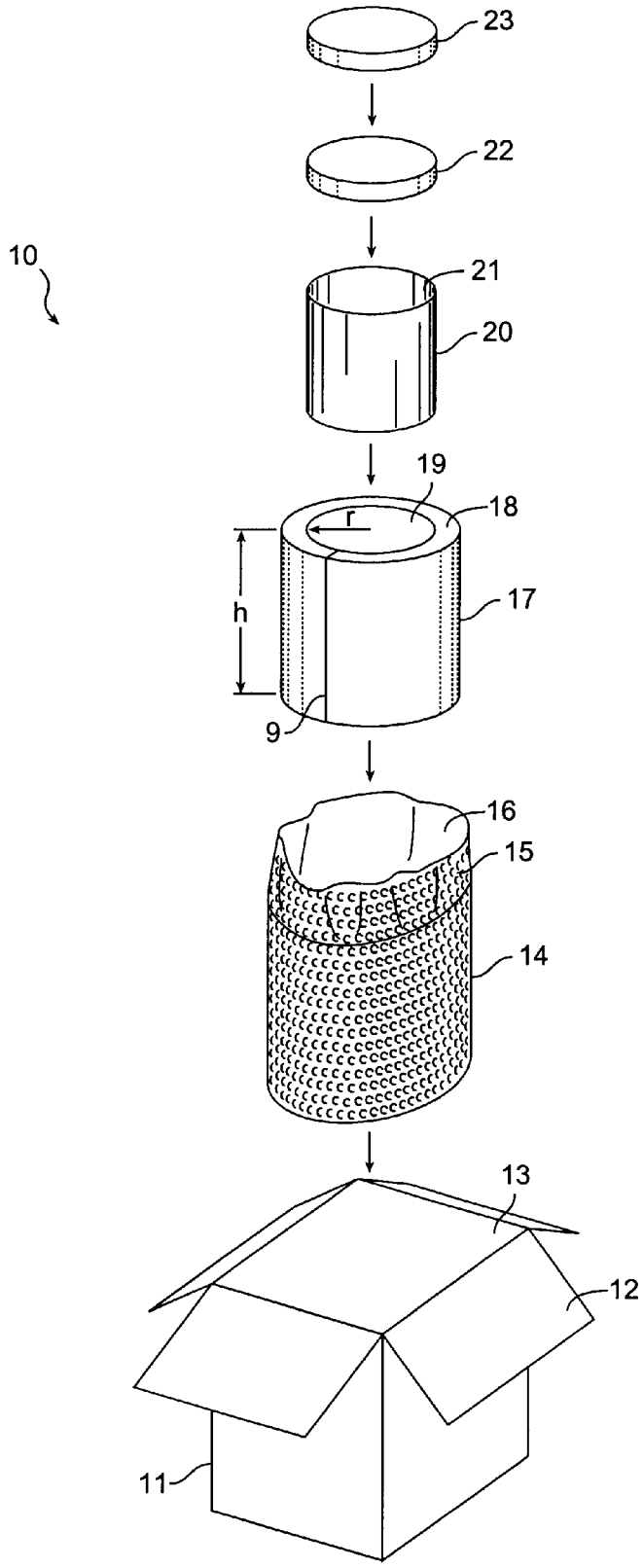
FIG. 1 is an exploded isometric illustration of the present invention broadly showing each of the components which constitute Applicant's inventive shipping container.
Figure 7:
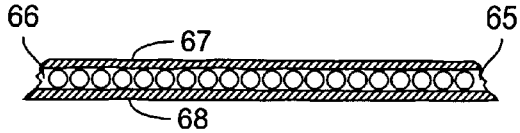
FIG. 7 is a partial cross-sectional view of one embodiment of a possible side wall construction of both the pouch and cylindrically shaped metalized membrane of FIG. 1.

Turning first to FIG. 1, the present shipping container 10 is shown in an exploded isometric view to enable one to appreciate how the various components making up the present invention nest within one another. The present shipping container employs flexible pouch 14 having end flaps 15 and an internal volume 16. Pouch 14, as well as cylindrically shaped metalized membrane 20, can consist of a wide variety of flexible insulating material such as aluminum metalized Mylar® which is a widely available polyester, the composite being sold by E.I. Dupont De Nemours & Co. Alternatively, pouch 14 and cylindrically shaped metalized membrane 20 can be composed of a multilayered membrane, as shown in FIG. 7. In this configuration, bubble wrap layer 66 is clad with aluminum layer 67 and 68. This composite is available from Reflectix, Inc. of Markleville, Ind. In either configuration, it is characteristic of the present invention to provide pouch 14 which can be unfolded to create an internal volume 16 and yet, in a folded condition, is capable of being stored in a flat, somewhat two-dimensional configuration. In fact, pouch 14 can be sold in a vacuum pack wrapping to further reduce its volume during storage.

Within volume 16 is provide cylindrically shaped elastomer 17 having a side wall 18 and internal volume 19. Elastomer 17 can be composed of any material which is thermally insulating and which is more resistant to deformation in its height dimension "H" than in its radial dimension "R". In possessing these characteristics, cylindrically shaped elastomer 17 can be made to lie flat either by pressing cylindrically shaped elastomer 17 against its side wall to collapse the elastomer radially or cylindrically shaped elastomer 17 can be composed of a rectangular piece of sheet material which is turned upon itself to create a cylinder but yet is capable of returning to its rectangular flat configuration by releasing a seam 9 which can be held in place by tape.

As noted above, due to the flexible nature of pouch 14 and cylindrically shaped elastomer 17, components of the present invention can be made to lie flat during storage while yet assuming a geometrical three-dimensional shape in use. In this regard, elastomer 17 is characterized as being resistant to deformation in its height dimension "H". As such, during use, once top 23 and bottom 22 have been fit within cylindrically shaped elastomer 17, a somewhat rigid structure is created providing both insulation and structural integrity housing a product (not shown) contained therein.

Within cylindrically shaped elastomer 17 is provided cylindrically shaped metalized membrane 21 having an internal volume 22. It is intended that metalized membrane 20 fit within elastomer 17 as providing yet another layer of insulation while acting as a somewhat moisture impervious side wall between the product enclosed within the container and cylindrically shaped elastomer 17 which can be composed of, for example, a polyolefin thermoplastic known as a flexible plastic foam available from Nomaco, Inc. of Zebulon, N.C., and sold under the trademarks NOMAPLY™ and WITECH®. Other possible polyolefins which may be useful in configuring elastomer 17 are TROCELLEN™ sold by Hule Troladrof AG (Germany), ARTICTHERM™ sold by Insulation Materials Corp., PORON™ sold by Rogers Corp. and INSUL-SHEET™ sold by Rubatex Corp. Other closed cell foams can also be used for elastomer 17 such as polyethylenes, vinyl foams, PVCs, nitrites, neoprene/EPDM, nitrile/hydrin blends and silicones The container of the present invention is completed by providing top 23 and bottom 22 which are intended to fit within cylindrically shaped elastomer 17. Ideally, as will be described in greater detail when reference is made to FIGS. 8 and 9, top 23 and bottom 22 are intended to frictionally fit within cylindrically shaped metalized membrane 20 by passing within its internal volume 21 and, due to the flexible nature of cylindrically shaped elastomer 17, act to define the shape of the container by deforming the shape of the elastomer by frictionally fitting therein.

Figure 2A:
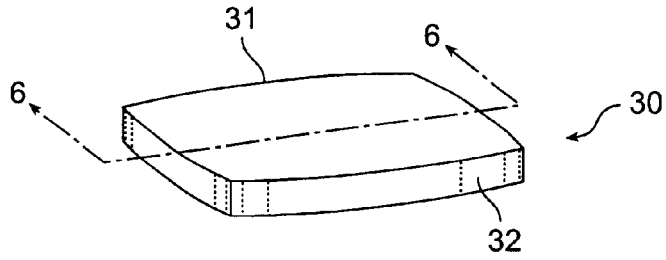
FIGS. 2A, 2B and 2C depict three different geometric configurations employed as tops and bottoms useful in completing the shipping container disclosed herein.
Figure 2B:
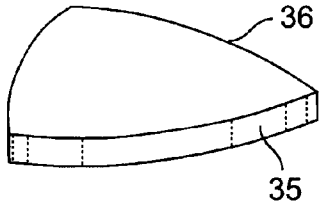
Figure 2C:
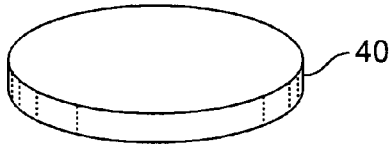

As noted in FIGS. 2A, 2B and 2C, the tops and bottoms used herein can be of virtually any geometrical shape, such as a square or rectangle (FIG. 2A), a triangle (FIG. 2B), or a circle (FIG. 2C). In turning to FIG. 2A, top or bottom 30, having a thickness 32, is provided with a peripheral edge 31. Due to the cylindrical nature of elastomer 17, peripheral edge 31 is generally configured in a slightly convex dimension to provide for a more form fitting relationship with cylindrically shaped elastomer 17. Likewise, in configuring top or bottom 35 (FIG. 2B), peripheral edges 36 making up triangle 35 are convex, the degree of curvature being somewhat determined by the flexibility of cylindrically shaped elastomer 17.

Figure 3:
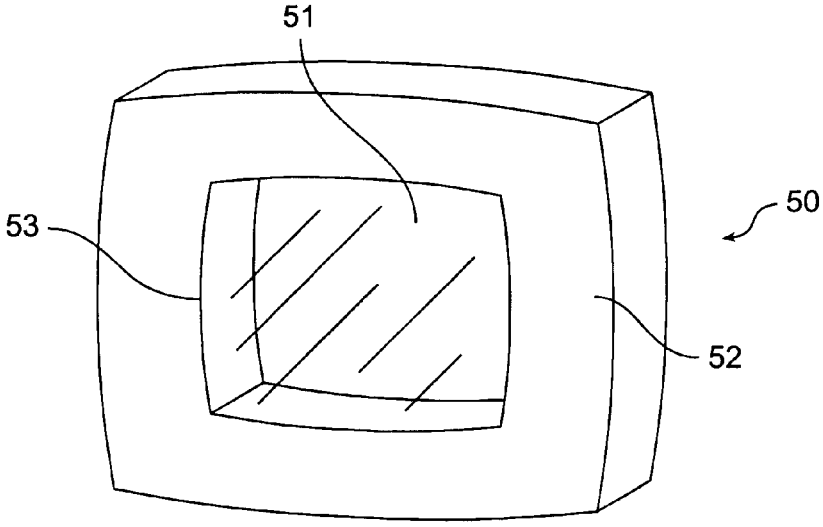
FIG. 3 is an isometric view of a preferred embodiment of Applicant's invention wherein a top is embodied with a transparent window.

Turning to FIG. 3, top 50 can, as a preferred embodiment, posses cutout region 53 within its body 52 for insertion of a transparent window 51. Transparent window 51 can be composed of plexiglass or any suitable acrylic which can be friction fit within body 52. The preferred embodiment shown in FIG. 3 would enable the contents of the insulated shipping container to be observed without having to remove top 50 and thus expose the shipped product to ambient temperatures.

Figure 4:
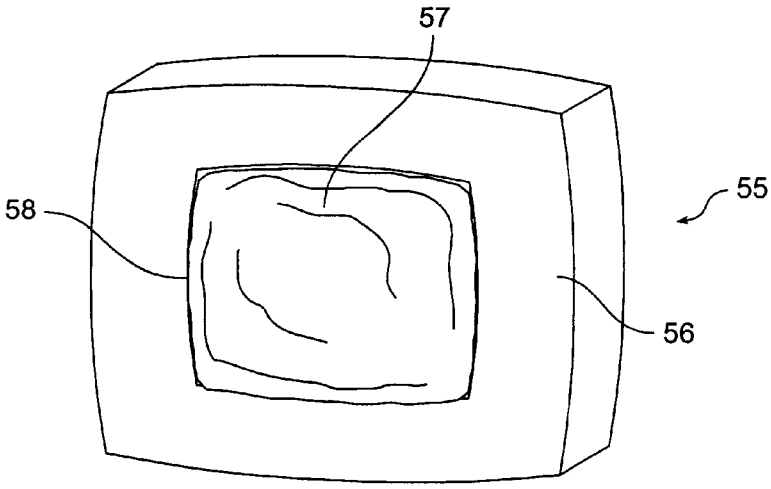
FIG. 4 is a further isometric view of a preferred embodiment where a cold pack is configured within a top or bottom of the present invention.

Yet a further embodiment of the present invention is shown in FIG. 4 where top 55 is provided with a cutout region 58 within its body 56. Within cutout region 58 is placed a cold pack 57 which can be snugly fit therein to prevent its inadvertent dislodgement. Although not shown, a similar configuration can be created within a bottom insert for retaining a suitable cold pack in the vicinity of the product being shipped.

Figure 5:
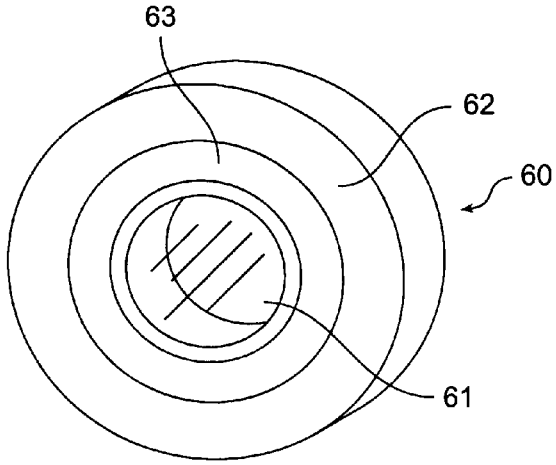
FIG. 5 is yet a further isometric view of a top of the inventive shipping container where both a cold pack and transparent window are provided.

Yet a further embodiment of the present invention is shown in FIG. 5. In this instance, top 60 is provided both with a transparent window 61 and cold pack 63 friction fit within body 62 of top 60. It is noted that cold pack 63 is configured in the shape of a donut so that transparent window 61 can provide a viewing space to the interior of the container without being blocked by the cold pack.

Figure 6:
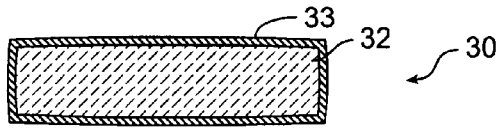
FIG. 6 is a cross-sectional view of the top shown in FIG. 2A.

As a further preferred embodiment, reference is made to FIG. 6 which shows top 30 (FIG. 2A) in cross-section. Top 30 can be composed of a number of insulated materials. In this instance, it is suggested that top 30 be composed of the same elastomer as is used to produce cylindrically shaped elastomeric member 17. Although top 30 is shown as having a single uniform piece of elastomer 32, it is suggested that top 30 can be composed of several sheets of elastomer to build up a suitable thickness either adhered together or adhesively sandwiching yet a further insulated layer, such as that shown in FIG. 7. In further reference to FIG. 6, it is suggested that a thin insulative layer 33 be used to envelope body 32. Applicant has found that a suitable material for this purpose is a metalized Mylar.

Figure 8:
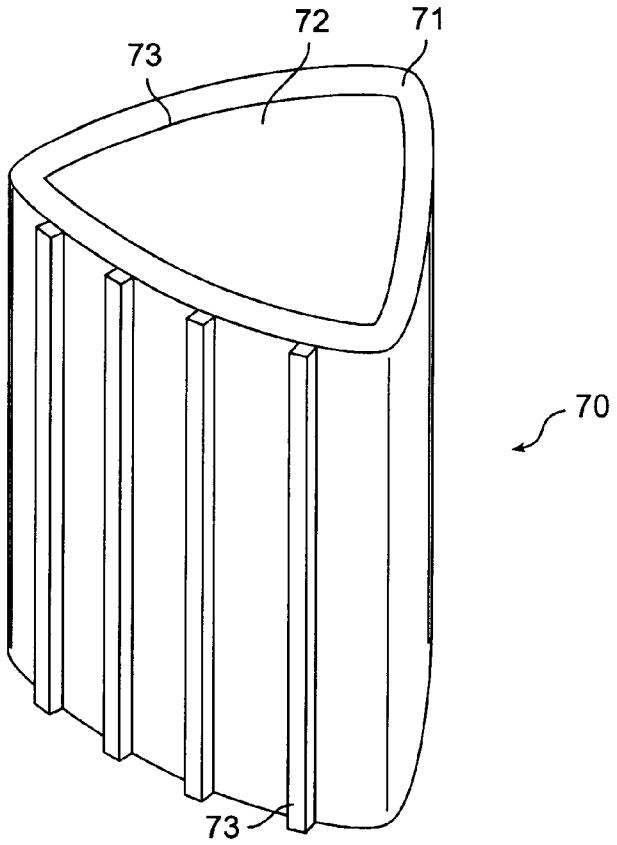
FIG. 8 is a isometric view of a cylindrically shaped elastomer whose geometry is dictated by a substantially triangularly shaped top.

FIG. 8 depicts a portion of the present invention whereby cylindrically shaped elastomer 70 is shown having substantially triangularly shaped top 72 frictionally pressed within side wall 71. As seen by FIG. 8, top 72, having convex triangular legs 73 making up somewhat of an equilateral triangle, forces cylindrically shaped elastomeric member 70 into a triangular configuration. As noted previously, elastomer 70 will assume the basic shape of frictionally fit top and bottom members to dictate the shape of the overall container.

As further shown in FIG. 8, as a preferred embodiment, ribs 73 can be included within the side wall 71 of the elastomeric member. Although only four ribs are shown, rib element 73 can continue throughout the entire external side wall of cylindrical member 70 as either added on strip elements or by forming relief areas within side wall 71 during manufacture of the elastomer. Elements 73 act as spacers as cylindrical elastomeric element 70 confronts an adjacent element in the form of either pouch 14 or adjacently configured cylindrically shaped metalized membranes 20. Such spacing acts to increase the insulative value of the overall composite constituting the shipping container of the present invention.

Figure 9:
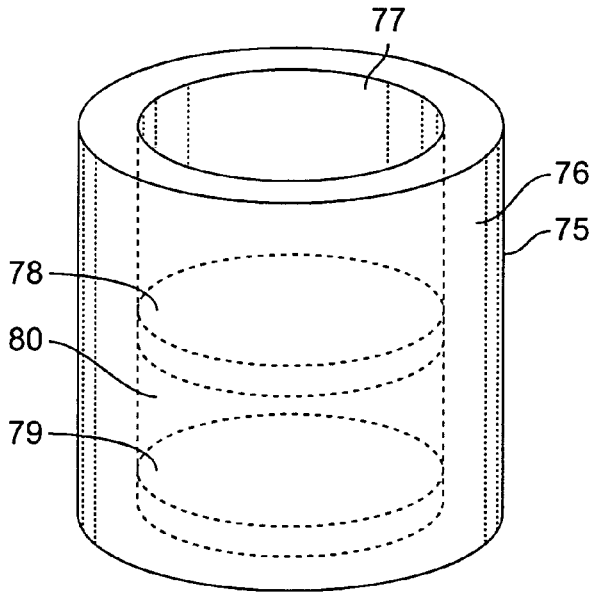
FIG. 9 is yet a further isometric view of a cylindrically shaped elastomer showing, in phantom, a top and a bottom frictionally fit therein to reduce the internal volume of the inventive shipping container.

Reference is further made to FIG. 9, which shows the frictional engagement of top 78 and bottom 79 within side wall 76 of cylindrical elastomeric member 75. In practice, bottom member 79 can be frictionally fit within opening 77 until bottom 79 assumes a position flush with the bottom of side wall 76. Thereupon, the product to be shipped (not shown) can be placed within cavity 80 and top 78 frictionally fit within opening 77. Top 78 can then be frictionally pressed within side wall 76 to dictate the size of volume 80. By reducing volume 80 to a minimum, the thermal integrity of volume 80 can be more easily maintained while ensuring that any included cold packs (not shown) are maintained in close proximity to the shipped product.

In practice, a user of the present invention would begin by opening and expanding flexible pouch 14 and placing cylindrical elastomeric member 17 therein. After the elastomeric cylindrical member has been inserted within pouch 14, cylindrically shaped metalized membrane 20 is placed within cylinder 17. If further insulation is required, yet another series of elastomeric cylinders and metalized membranes can be additionally nested within each other whereupon bottom member 22 can be frictionally pressed within the composite to establish a suitable floor for the product to be shipped. The product can then be inserted within the shipping container and one or more cold packs can be optionally employed either by placing them loosely within the internal volume of the container or by frictionally fitting them within the top and/or bottom members. Top 23 can then be frictionally fit within the cylindrical composite and frictionally pressed within the composite to reduce the internal volume of the container in order to match the needs of the shipped product. Once all of this is done, pouch 14 can be compressed by hand creating somewhat of a vacuum within its internal space 16 and flaps 15 brought together and clamped. The bag-like composite can then, optionally, be placed within cardboard box 11 within its internal space 13 and flaps 12 brought together and sealed.

In summary, it is quite apparent that the present invention, for the first time, provides for an extremely convenient shipping container having consumer selectable insulating characteristics which can be stored in a substantially flat, low volume state and yet which is capable of assuming a variety of geometrical configurations in use. The shipping container is resistant to vertical compaction and is reusable, thus making the product more environmentally friendly than those Styrofoam® or polyurethane shipping containers to which it will compete.

What is claimed is:

1. A container having insulating properties for shipping products, said container comprising a flexible pouch capable of being folded to a substantially flat, two-dimensional geometry, at least one cylindrically shaped elastomer having a radial dimension and height dimension, shaped to fit within said flexible pouch and being more resistant to deformation in its height dimension than in its radial dimension, at least one cylindrically shaped metalized membrane sized to fit within said cylindrically shaped elastomer, a geometrically shaped top and bottom each sized to fit within said cylindrically shaped elastomer, and each determining the shape of the container by deforming the shape of the cylindrically shaped elastomer.

2. The container of claim 1 further comprising alternating layers of said cylindrically shaped elastomer and cylindrically shaped metalized membrane.

3. The container of claim 1 wherein said elastomer is characterized as having at least one surface having ridges configured therein.

* * * * *